United States Patent [19]

Holbrook

[11] Patent Number: 5,011,129

[45] Date of Patent: Apr. 30, 1991

[54] JAM CLEARANCE APPARATUS FOR SHEETFEEDING DEVICE

[75] Inventor: Russell W. Holbrook, Middlebury, Conn.

[73] Assignee: Pitney Bowes Inc., Stamford, Conn.

[21] Appl. No.: 435,906

[22] Filed: Nov. 14, 1989

[51] Int. Cl.[5] ..... B65H 5/02; B65H 5/04

[52] U.S. Cl. ..... 271/274; 271/273; 198/624; 198/836.2

[58] Field of Search ..... 271/256, 257, 258, 273, 271/274; 198/624, 836.2

[56] References Cited

U.S. PATENT DOCUMENTS

| | | | |
|---|---|---|---|
| 2,841,298 | 7/1958 | Walsh et al. . | |
| 2,964,374 | 12/1960 | Streeter . | |
| 3,411,771 | 11/1968 | Bahr et al. . | |
| 3,618,934 | 11/1971 | Germuska | 271/274 |
| 3,861,516 | 1/1975 | Inose et al. . | |
| 4,163,491 | 8/1979 | Rock et al. . | |
| 4,431,179 | 2/1984 | Westover et al. | 271/274 |
| 4,630,815 | 12/1986 | Petersen et al. | 271/273 |
| 4,632,382 | 12/1986 | Heist et al. . | |
| 4,754,867 | 7/1988 | De Anda . | |
| 4,815,726 | 3/1989 | Pagowski et al. . | |

*Primary Examiner*—Robert P. Olszewski
*Assistant Examiner*—Tuan N. Nguyen
*Attorney, Agent, or Firm*—Charles G. Parks, Jr.; David E. Pitchenik; Melvin J. Scolnick

[57] ABSTRACT

A jam clearance device is incorporated in a sheetfeeding device. The sheetfeeding device includes a deck and registration wall set at a right angle to the deck. A plurality of drive rollers are rotatively mounted within the sheetfeeding device such that a portion of the drive rollers extend through respective slots in the deck slightly above the transport surface of the deck. The jam clearance device includes a support frame fixably mounted to the sheetfeeding device. A plurality of biasing wheels are rotatively mounted to the support frame such that the biasing wheels are biased in a home position against a respective one of the drive wheels and are positionable to a second position vertically displaced from the respective drive wheel. A handle is provided for positioning the biasing wheels in the home position or the second position.

2 Claims, 4 Drawing Sheets

JAM CLEARANCE APPARATUS FOR SHEETFEEDING DEVICE

BACKGROUND OF THE INVENTION

This invention relates to the field of sheetfeeding apparatus, and more particularly, to envelope feeders.

Envelope sheetfeeders are generally required to transport envelopes from one location to another location along a deck. Conventionally, a plurality of drive rollers under the influence of a prime mover are rotatively mounted below the deck such that a radial portion of each roller is location slightly above the deck extending through aligned openings in the deck. The rollers encountering an envelope traversing the surface of the deck and acting as a prime mover on the envelope. To assist in providing positive control of the envelope, it is conventional to utilize biasing rollers mounted above the deck for applying a downward load on a traversing envelope to increase the friction contact between the drive rollers and the envelope. It is a common experience for an envelope to become jammed in the feeder.

SUMMARY OF THE INVENTION

It is the object of the present invention to disclose a jam clearance apparatus which facilitates the easy removal of an envelope jammed in a feeder.

The feeder includes a deck and a plurality of drive rollers rotatably mounted in the feeder below the deck such that a radial portion of each roller is located and slightly above the deck extending through aligned slots in the deck. The jam clearing apparatus is comprised of a support frame mounted to the feeder. The support frame supporting a plurality of biasing rollers. The biasing rollers are rotatively mounted to a wheel shaft. The wheel shaft is fixably mounted at its ends to respective link arms which are pivotally mounted in the frame and spring biased in the downward direction.

A lever arm is pivotally mounted to the frame for coaction with a slide member, such that, the lever arm can be displaced over center and thereby act on the slide member to cause the slide member to slidably displace. Displacement of the slide member brings the slide member into contact with the link arms resulting in arched displacement of the biasing rollers. Displacement of the biasing rollers in this manner causes a gap between the biasing rollers and the deck, such that, a envelope jammed therebetween may be easily removed.

DETAILED DESCRIPTION OF THE PREFERRED EMBODIMENT

Figure 1:
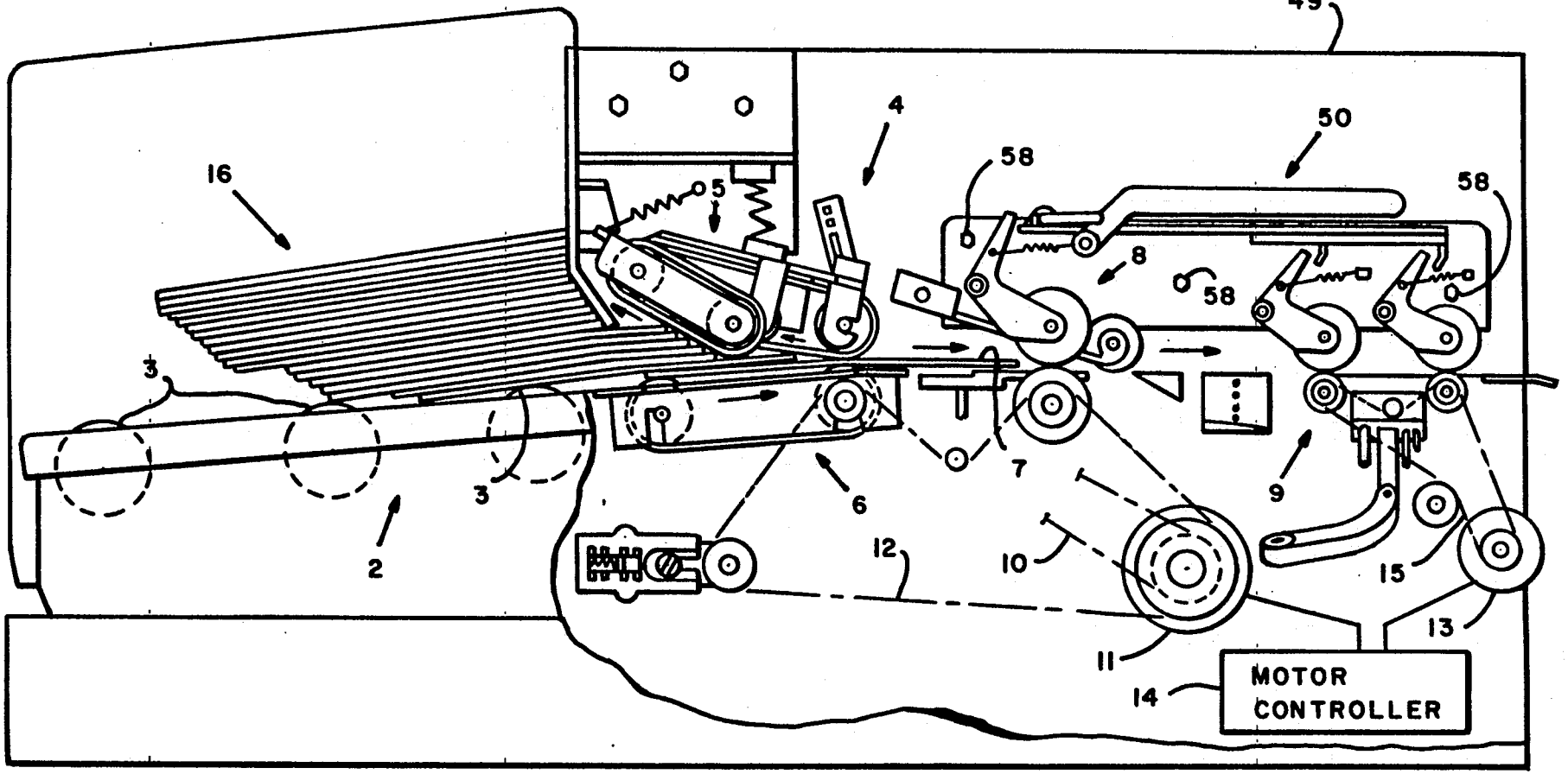
FIG. 1 is a side elevated view of a envelope feeder having a jam clearance apparatus in accordance with the present invention.

Referring to FIG. 1, an envelope feeder, generally indicated as 1, includes an envelope separator station 2 for receiving an envelope stack 16. At the separator station 2, the bottom most envelopes are caused by driven rollers 3 to be received by a singulator station 4. The singulator station 4 is generally comprised of a reverse belt drive assembly 5 and a forward belt drive cartridge 6. The reverse belt drive assembly 5 is of a suitable construction. From the separator station 2, the bottom most envelope 7 is advanced to a flap separation station 8 by the belt drive cartridge 6. The envelope 7 is then advanced to a flap moistening station 9 from which the envelope 7 passes to any suitable apparatus, such as a mailing machine.

A motor 11 is an endless belt 12 communication with the belt drive cartridge 6 and the flap moistening station 8 through a suitable power train. The motor 11 is also in communication with the reverse belt drive assembly 5 via a belt 10. A second motor 15 is in communication with the moistening station 9 through a suitable power train such as by belt 15. The separation distance between successive feeder stations 2, 4, 8, and 9, in the preferred embodiment, is less than the length of the smallest envelope intended to traverse the feeder 1. The motors 11 and 13 are under the control over programmable microprocessor based motor controller 14.

Figure 2:
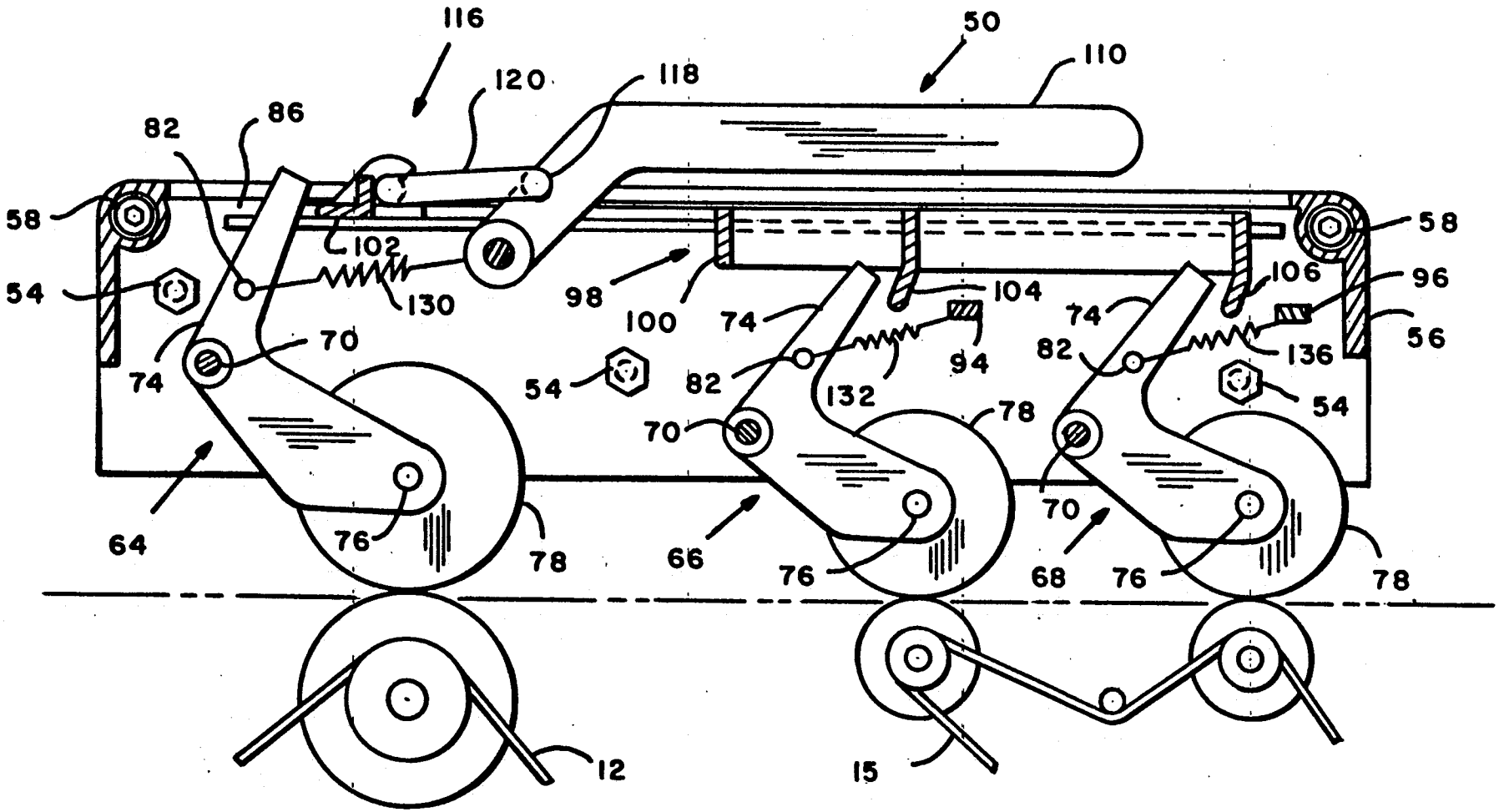
FIG. 2 is a elevated side sectional view of a jam clearance apparatus in accordance with the present invention.
Figure 3:
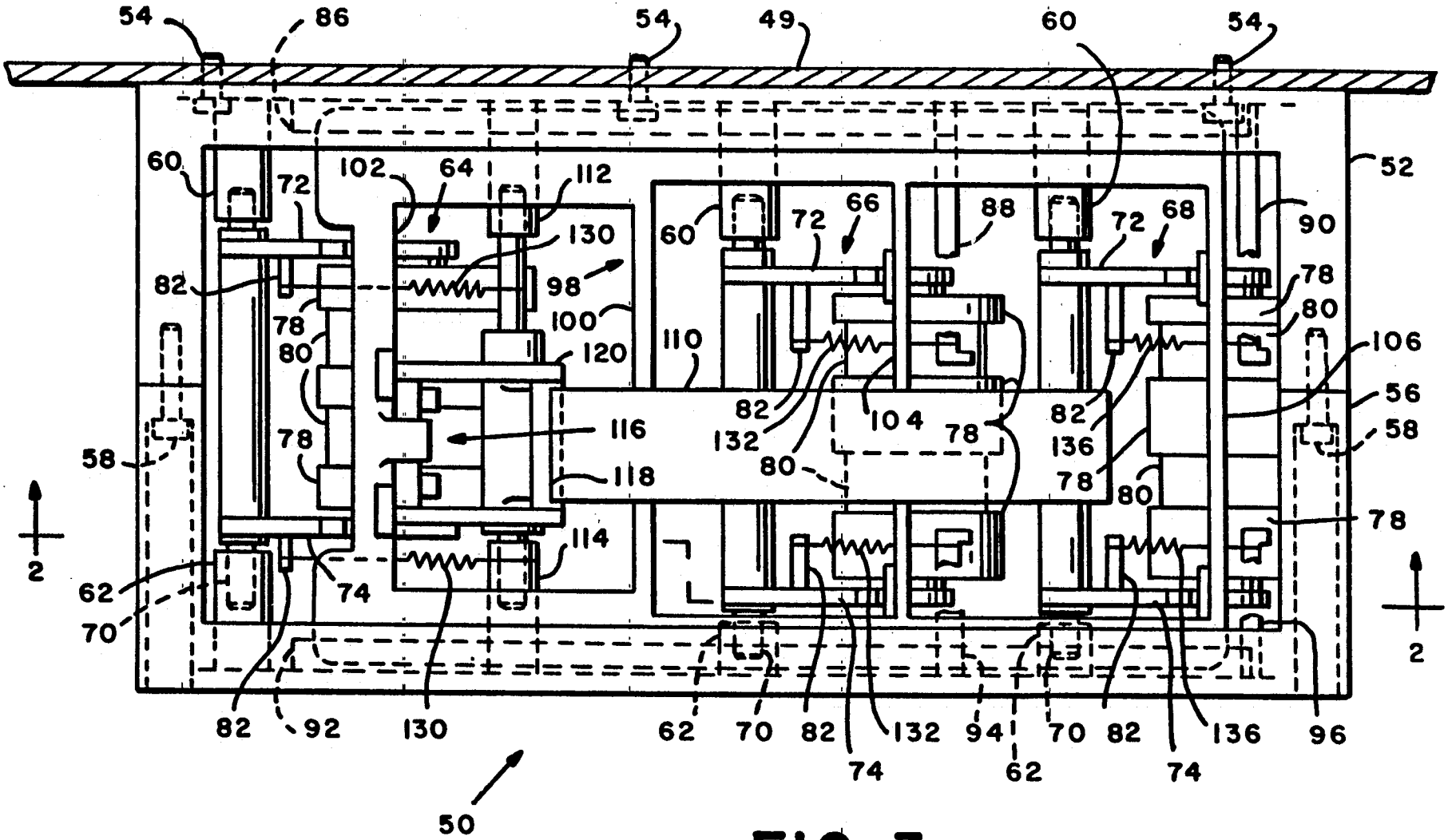
FIG. 3 is a sectioned top view of the jam clearance apparatus.

Referring to FIGS. 2 and 3, the jam clearance device, generally indicated as 50, is comprised of a two piece frame having frame sections 52 which is mounted to the registration wall 49 by any conventional means, such as by bolts 54. A second frame section 56 is fixably mounted to frame section 52 by any conventional means, such as by bolts 58 (refer to FIG. 3). A plurality of hubs 60 are formed in the frame section 52 and a plurality of hubs 62 are formed in the frame section 56.

A plurality of wheel assembly 64, 66, and 68 are pivotally mounted to the jam clearance apparatus. Each wheel assembly 64, 66, and 68, respectively, is comprised of a shaft 70 pivotally mounted at its ends in respective hubs 60 and 62. Each shaft 70 includes link arms 72 and 74 in spaced apart relationship. A wheel shaft 76 is mounted at its ends to the respective link arm 72 and 74. Biasing wheels 78 are rotatively mounted to the wheel shaft 76. A plurality of spacers 80 are placed between the biasing wheels 78. Each arm 72 and 74 has formed thereon a tab 82.

Frame section 52 includes a channel 86 and inwardly extending beams 88 and 90 mounted to the frame section 52 in cantilever fashion. In like manner, the frame section 56 includes a longitudinally extending channel 92 and beams 94 and 96. A frame section 98 is slidably captured in the channel 86 to one side and channel 92 on the other side.

The frame section 98 is comprised a cross beam 100 and a cross beam 102 which are aligned to the other end of arms 72 and 74 of wheel assembly 64. The frame section 98 further includes a cross member 104 aligned to the other end of arm 72 and 74 of wheel assembly 66, and a cross member 106 which is aligned to the other end of arm 72 and 74 of wheel assembly 68. A over center handle 110 is pivotally mounted in hub 112 formed in frame section 52 and hub 114 which is formed in frame section 56. A snap clamp 116 is formed in the cross member 102 and a C-receiver 118 is formed in the handle 110, such that a buckle 120 is received in the snap clamp 116 and the C-recess 118.

A plurality of springs are extended between the tab 82 of wheel assembly 64 at one end and the handle 110 to place a spring biasing force on the wheel assembly 64. A second plurality of springs 132 is extended between the tab 82 of wheel assembly 66 and the post 88 and 94.

A third plurality of springs 136 is extended between the tab 82 of the wheel assembly 68 and the post 90 and 96.

Figure 4:
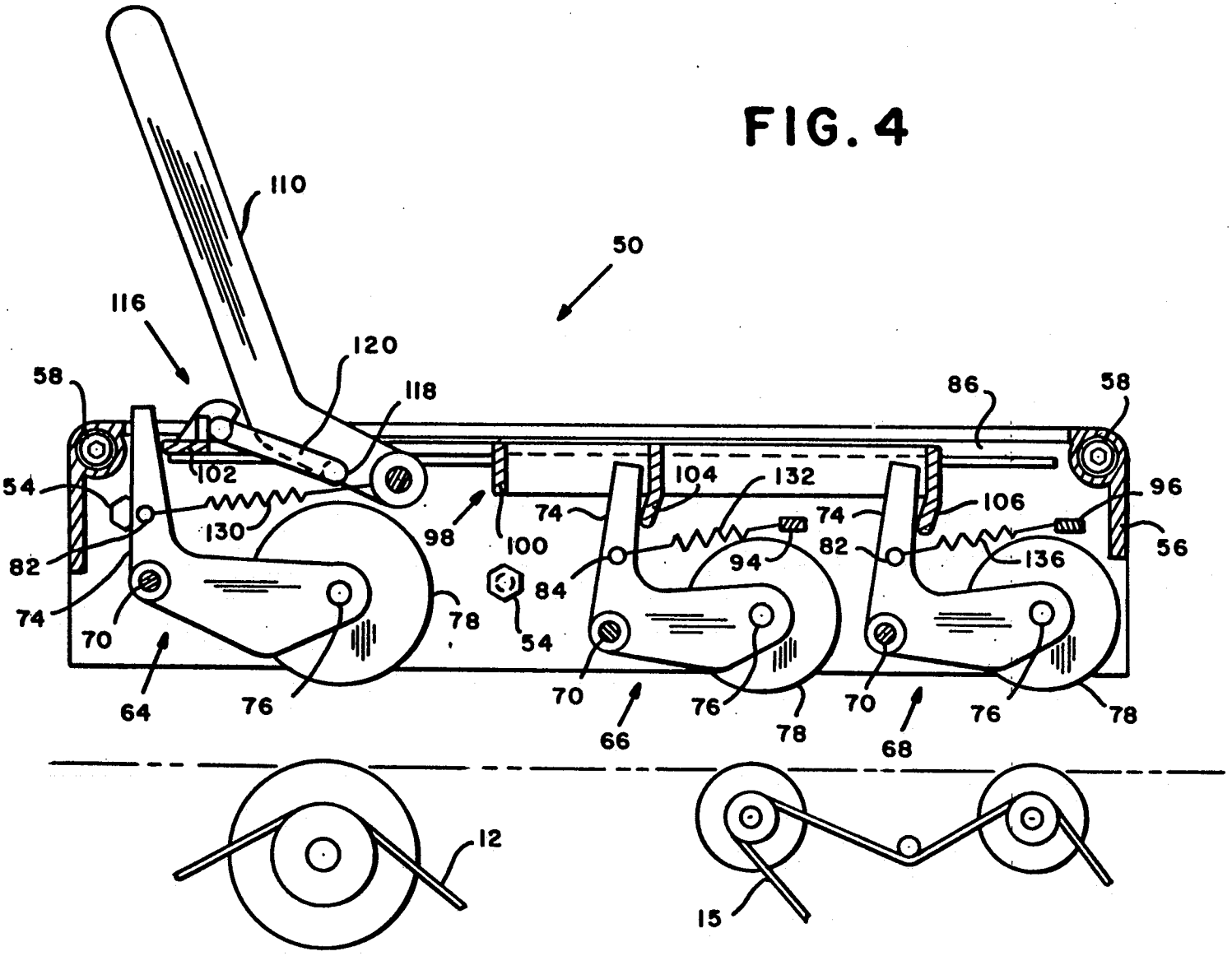
FIG. 4 is a side elevated view of the jam clearance apparatus in its second position.

Referring to FIGS. 2 and 4, it is now observed that by pivotally displacing the handle over center, the buckle 120 causes the frame assembly 98 to slidable displace forwardly or rearwardly within the channels 86 and 92. The slidable displacement of the frame 98 abuts the cross arms 72 and 74, such that the wheel assembly is caused to pivotally displace upward and thereby allowing jam clearance between the biasing rollers 78 and the drive rollers.

What is claimed is;

1. A jam clearance device for a sheetfeeding device, said sheetfeeding device having a deck and registration wall, a plurality of drive rollers rotatively mounted within said sheetfeeding device such that a portion of said drive rollers extend through respective slots in said deck slightly above the transport surface of said deck, said jam clearance device comprising:

a support frame fixably mounted to said sheetfeeding device;

a plurality of biasing wheels rotatively mounted to said support frame such that said biasing wheels are biased in a home position against a respective one of said drive rollers and are positionable to a second position vertically displaced from said respective drive rollers;

handle means for positioning said biasing wheels in said home position or said second position;

said support frame having a first frame section fixably mounted to said registration wall having a plurality of pivot shafts pivotally mounted to said first frame section, each of said pivot shafts having a plurality of linking arms fixably mounted generally perpendicular along its length to said pivot shaft, a plurality of wheel shafts fixably mounted to one end of said linking arms of said respective pivot shaft, said biasing wheels rotatably mounted to said respective wheel shaft;

biasing means for causing said linking arms to bias said biasing wheels against said rollers in said home position;

said handle means being positionable from a home position to a second position or causing said linking arms to pivot said pivot shaft, in said second position, and thereby causing said linking arms to raise said biasing wheels, said handle means including a second frame slidably mounted to said first frame such that said second frame may be positioned from a first position to a second position, said second frame having cross beam members respectively aligned opposite said linking arms of said respective pivot shaft such that displacement of said second frame causes said cross beam members to abuttingly displace said respective linking arms;

a handle pivotally mounted to said first frame such that said handle may be positioned from a first position to a second position over center; and buckle means pivotally mounted to said second frame and said handle for causing said second frame to displace in response to displacement of said handle.

2. A jam clearance device for a sheetfeeding device, said sheetfeeding device having a deck and registration wall, a plurality of drive rollers rotatively mounted within said sheetfeeding device such that a portion of said drive rollers extends through respective slots in said deck slightly above the transport surface of said deck, said jam clearance device comprising:

a support frame having a first frame section fixably mounted to said registration wall and a second frame section displaceably mounted to said first frame such that said second frame section is positionable in a first or second position;

a plurality of biasing wheels rotatively mounted to said first frame section such that when said first frame section is in said first portion said biasing wheels are biased against respective drive rollers and when said first frame section is in said second position said biasing wheels are biased apart from said respective driver rollers;

a handle pivotally mounted to said first frame section such that said handle may be positioned from a first position to a second position over center; and, buckle means pivotally mounted to said second frame and said handle for causing said second frame to displace in response to displacement of said handle.

* * * * *